US005522560A

United States Patent [19]

Fleissner

[11] Patent Number: 5,522,560

[45] Date of Patent: Jun. 4, 1996

[54] DOUBLE-BOBBIN DEVICE

[75] Inventor: Gerold Fleissner, Zug, Switzerland

[73] Assignee: Fleissner GmbH & Co., Binzen, Germany

[21] Appl. No.: 212,727

[22] Filed: Mar. 14, 1994

[30] Foreign Application Priority Data

Mar. 13, 1993 [DE] Germany ..... 43 08 003.0

[51] Int. Cl.[6] ..... B65H 54/00; B65H 67/044

[52] U.S. Cl. ..... 242/18 A; 242/25 A; 242/18 PW

[58] Field of Search ..... 242/18 A, 25 A, 242/18 PW

[56] References Cited

U.S. PATENT DOCUMENTS

| | | | |
|---|---|---|---|
| 2,984,425 | 5/1961 | Thayer | 242/18 A |
| 3,051,403 | 8/1962 | Johnson | 242/25 A |
| 3,064,912 | 11/1962 | Bittman | 242/25 A |
| 3,813,050 | 5/1974 | Landwehrkamp | 242/18 A |
| 4,103,835 | 8/1978 | List | 242/18 A |
| 4,111,376 | 9/1978 | Hoddinott et al. | 242/25 A |
| 4,291,841 | 9/1981 | Dalrymple et al. | 242/18 A |
| 4,784,341 | 11/1988 | Hill et al. | 242/18 A |
| 4,848,687 | 7/1989 | Myers et al. | 242/18 A |

*Primary Examiner*—Michael R. Mansen
*Attorney, Agent, or Firm*—Antonelli, Terry, Stout & Kraus

[57] ABSTRACT

Only one of the two bobbins located side by side is wound at a time. When one bobbin is full, a thread guide must switch the thread to the adjacent empty bobbin. In order to keep the thread wound up on the full bobbin from unwinding, it is held by a pressure applying element such as a brush, against the immediately adjacent bobbin flanges until the loop between the bobbins is cut by a cutter.

4 Claims, 1 Drawing Sheet

DOUBLE-BOBBIN DEVICE

FIELD OF THE INVENTION

This invention relates to a double-bobbin device for continuous winding of threads or the like materials onto two rotating bobbins, axially flush with one another, arranged side by side and driven axially, only one of the bobbins being wound at a time, the device having a traversing device movable parallel to the bobbin axes to guide the thread back and forth during the working process in a direction parallel to the bobbin axis, and a winding aid, associated with the bobbins, which grasps the thread when changing from the full to the empty bobbin and holds it against the bobbins at least until the thread is severed by a cutter associated with the device.

BACKGROUND OF THE INVENTION

A device of this kind is known from DE-AS 10 56 083. The winding aid in that device consists of a plurality of clamps arranged on the circumference of the bobbin flange which grasp the transferred thread and hold it for cutting. Devices of this type are not only very expensive to manufacture but also necessitate a change in the bobbin flange. Bobbins, however, are manufactured in large numbers, so that any change in bobbin design should not only be avoided but is rejected by the industry.

The goal of the invention is to provide a winding aid with which the thread being switched from the full bobbin to the adjacent empty bobbin can be held securely on the bobbins without the structural design of the bobbins having to be affected.

To achieve this goal, the invention provides that the winding aid is designed as a pressure element such as a brush or a roller which extends only over the width of the immediately adjacent bobbin flange and abuts only the bobbin flange circumferential surfaces that project radially outward. It is not apparent at the outset that such a stationary pressure element can achieve the stated goal, because it continuously relaxes its hold as the bobbin continues to rotate. Tests have shown, however, that the brief holding effect at the high circumferential speeds of the bobbins is sufficient to prevent the thread from unwinding from the full bobbin. If the thread is cut between the two adjacent bobbins and the full bobbin is ready to be taken away, the thread jumps up and must then be held against the winding. Brushes for this purpose are known from Swiss Patent 239 933 and rollers are known from DE 34 46 691 A1, but these elements merely abut the wound material. Pressure devices of this kind, however, cannot prevent the end of the thread from unwinding during the switch to the empty bobbin because the last turns can be wound up quite tightly against the bobbin flange, where the known roller or the like cannot exert any grip. In addition, the thread must also be held at the flange of the empty bobbin.

BRIEF DESCRIPTION OF THE DRAWINGS

An embodiment according to the invention is further described with reference to the accompanying drawings wherein.

DETAILED DESCRIPTION OF THE INVENTION

Figure 1:
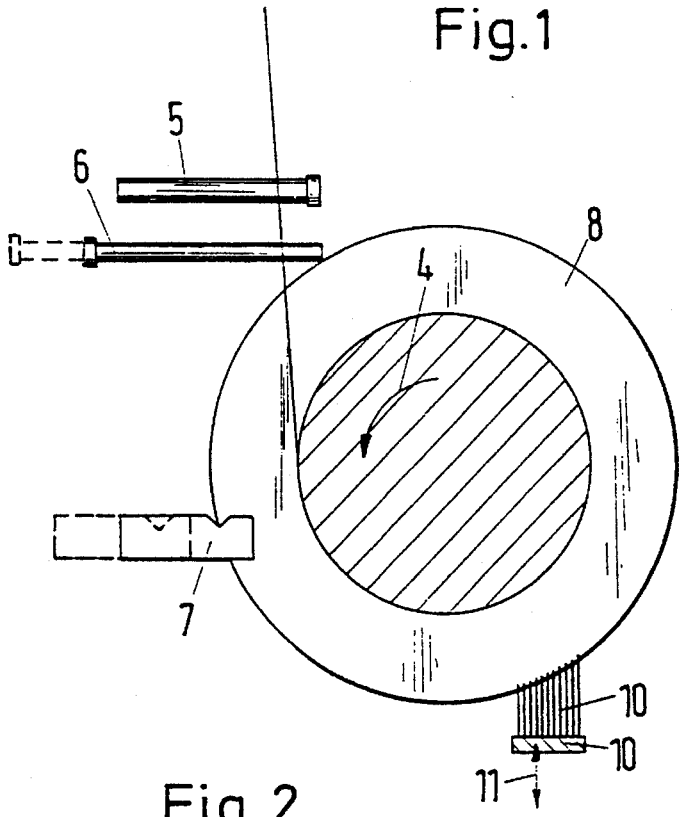
FIG. 1 is a side view, partially in section showing one bobbin of a double-bobbin device.
Figure 2:
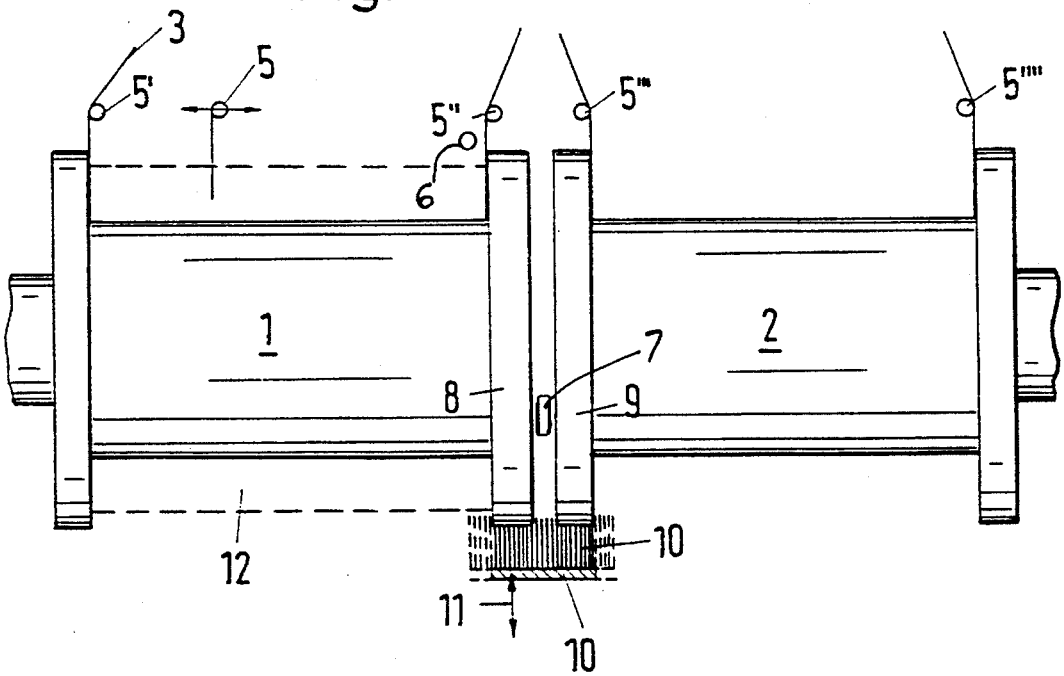
FIG. 2 is a top view of the double-bobbin device.

In FIG. 1, one unit of a double-bobbin machine consists of two bobbins 1 and 2 which are arranged axially flush, i.e. coaxially and close together while being wound with a thread 3. Bobbins 1 and 2 are driven separately in the direction of arrow 4. The traversing thread guide 5 is mounted above bobbins 1 and 2 so that it can travel back and forth, namely for winding bobbin 1, from position 5' to position 5". During winding, thread transfer guide 6 is retracted into the resting or inoperative position (dashed lines). The same is true of thread cutter 7 located between bobbins 1 and 2, which is also retracted in the resting or inoperative position.

When bobbin 1 is fully wound, thread transfer guide 6 moves into the advanced position and pulls the thread over the two adjacent edges 8, 9 of the two bobbins 1 and 2 to bobbin 2, where traversing thread guide 5 for winding this bobbin 2 travels back and forth from position 5''' to position 5''''. At the same time, thread cutter 7 located between bobbins 1 and 2 moves into the cutting position shown and severs thread 3, whereupon bobbin 1 can be braked, swung out of the winding position shown, and taken away.

In order to prevent the thread from jumping off full bobbin 1 when switching to empty bobbin 2, so that the loose thread loop is shorter when wrapped around bobbin 2, a brush 10 is pressed against the bobbin flange circumferential surface of flanges 8 and 9. It extends only over the width of the two bobbin flanges 8 and 9, and the space between flanges 8 and 9 can also be free of brush hairs. The brush can also be made slightly wider than the width of the two flanges 8 and 9, as indicated by the dashed lines. In any case, the brushes should not touch wound material 12 which ends below the level of the bobbin flange circumferential surfaces. By this simple addition to the device, the cut thread ends can be kept much shorter, to a third of the length, without a pressure device. Brush 10 can also be replaced by a roller and be mounted so that it can move back and forth on the machine in the direction of arrows 11, so that it projects only when thread 3 is being switched from one bobbin to the other and otherwise likewise remains in the resting position.

Brush 10 is intended to prevent the thread from winding up into a larger loop when transferred to the empty bobbin. This loop would then slide around the two bobbins, and larger ends would slide around the bobbins after cutting. The gripping of the thread loop performed at each revolution by brush 10, therefore, prevents only the large loop. The free thread must be gripped otherwise in a conventional manner.

What is claimed is:

1. A double-bobbin device for continuous winding of threads which comprises two rotating bobbins, each bobbin having end flanges and being arranged axially flush with one another, side by side, and driven axially, with only one of said bobbins being wound with a thread at a time; a traversing device that travels parallel to the axis of each bobbin and contacts the thread to guide the thread back and forth between the respective bobbin flanges during winding of the thread in a direction parallel to the bobbin axis; a thread transfer guide which advances toward the bobbin, which engages the thread to transfer the thread from the full bobbin to the adjacent empty bobbin, and which moves the thread pass two immediately adjacent bobbin flanges during said transfer; a cutter mounted between the two bobbins for cutting the thread; and a winding aid associated with the bobbins which grasps the thread during the transfer from the full to the empty bobbin and holds the thread against the adjacent bobbin flanges of the two bobbins at least until the thread is cut by means of the cutter; said winding aid comprising a pressure applying element which extends only over a width of the immediately adjacent bobbin flanges and which abuts only circumferential surfaces of the immediately adjacent bobbin flanges that project radially outward to hold the thread.

2. A device according to claim 1, wherein the pressure applying element is mounted to move back and forth on the double-bobbin device so that the element is movable between a contact position with respect to the flanges of said bobbins during abutment with the circumferential surfaces and a non-contact position during winding of the thread on the respective bobbins.

3. A device according to claim 1, wherein the pressure applying device is a brush.

4. A device according to claim 1, wherein the brush is arranged so that ends of the brush contact the adjacent bobbin flanges without touching wound thread on the full bobbin.

* * * * *